US005205021A

United States Patent [19]

Durand

[11] Patent Number: 5,205,021

[45] Date of Patent: Apr. 27, 1993

[54] QUICK RELEASE BUCKLE ASSEMBLY

[75] Inventor: Philip E. Durand, Hudson, Mass.

[73] Assignee: The United States of America as represented by the Secretary of the Army, Washington, D.C.

[21] Appl. No.: 883,507

[22] Filed: May 15, 1992

[51] Int. Cl.[5] ..... A44B 11/00

[52] U.S. Cl. ..... 24/163 R; 24/170

[58] Field of Search ..... 24/163, 170, 197, 200, 24/637, 645, 616, 633, 419, 429, 30.5 R, 30.5 L, 30.5 W

[56] References Cited

U.S. PATENT DOCUMENTS

| | | | |
|---|---|---|---|
| 2,526,705 | 10/1950 | Smith | 24/230 |
| 2,920,366 | 1/1960 | Pederson | 24/170 |
| 3,165,802 | 1/1965 | Irvin | 24/197 |
| 3,200,463 | 8/1965 | Craven et al. | 24/230 |
| 3,469,872 | 9/1969 | Damm et al. | 24/645 |
| 3,641,634 | 2/1972 | Asai | 24/429 |
| 3,818,548 | 6/1974 | Meyerson | 24/170 |
| 4,030,689 | 6/1977 | Rodriquez | 244/151 |
| 4,684,083 | 8/1987 | Maziarz | 244/151 |
| 4,688,337 | 8/1987 | Dillner et al. | 24/616 |
| 4,713,865 | 12/1987 | Geldwerth | 24/616 |
| 4,937,923 | 5/1990 | McEntire | 24/647 |
| 4,999,846 | 3/1991 | Ball et al. | 24/170 |
| 5,083,349 | 1/1992 | Axtell | 24/429 |

FOREIGN PATENT DOCUMENTS

| | | | |
|---|---|---|---|
| 0016550 | 2/1913 | France | 24/637 |
| 0466501 | 5/1937 | United Kingdom | 24/645 |

OTHER PUBLICATIONS

ITW Nexus Catalogue, "Plastic Buckles", p. 13, 1989.

*Primary Examiner*—Victor N. Sakran
*Attorney, Agent, or Firm*—Richard J. Donahue; Anthony T. Lane

[57] ABSTRACT

A quick-release buckle assembly including an engaging member that is adapted to receive a strap, and a receiving member defining a recess for removably receiving the engaging member in a buckle-engaged position. The engaging member in the buckle-engaged position is substantially completely within the peripheral bounds of the recess to prevent inadvertent disengagement of the engaging member from the receiving member. The assembly further includes a flexible tongue protruding from the engaging member to allow the engaging member to be pulled out of the recess to disengage the buckle.

15 Claims, 2 Drawing Sheets

QUICK RELEASE BUCKLE ASSEMBLY

GOVERNMENT RIGHTS

The invention described herein may be manufactured, used and licensed by or for the government for governmental purposes without the payment to me of any royalties thereon.

FIELD OF INVENTION

This invention relates to a quick-release buckle assembly that inhibits inadvertent buckle disengagement and allows operation with gloved hands.

BACKGROUND OF INVENTION

There are myriad types of buckles that have been used for many purposes. Buckles are often used to releasably fasten together straps. For example, helmet designs often include buckles for the chinstrap that provide the user with means of fastening and releasing the chinstrap to facilitate use of the helmet.

Helmet chinstrap buckles have taken a variety of forms. Some use two "D" shaped elements through which one strap is threaded to adjustably fasten together the two portions of the chinstrap. Other buckles include two or more buckle elements that mate in any number of fashions in an engaged state and are releasable through some means on one or more of the buckle elements. One such buckle includes an engaging member with a protruding operating section that can be inadvertently caught, prematurely releasing the buckle.

These buckles are frequently relatively complex mechanisms that are difficult to engage and sometimes difficult to release. These problems have caused many chinstrap buckles to perform poorly on helmets. Paratroopers in particular require a buckle that is easily releasable by the user, while not being easily inadvertently released; such a buckle would inhibit accidental release while still allowing the paratrooper to release the buckle in an emergency situation such as when the helmet gets caught during a jump.

For any combat soldier, it is important that the helmet chinstrap buckle be operable while the user is wearing gloves or mittens. This is important or essential when the soldiers are in extreme cold or operating under a chemical environment. Further, the metal buckle parts of many helmet chinstraps can act as secondary missiles that are capable of injuring the wearer.

SUMMARY OF INVENTION

It is therefore an object of this invention to provide a quick-release buckle assembly that is extremely easy to operate.

It is a further object of this invention to provide such a buckle assembly that may be operated while wearing gloves or mittens.

It is a further object of this invention to provide such a buckle assembly that is easy to disengage in an emergency situation.

It is a further object of this invention to provide such a buckle assembly that inhibits premature or accidental opening.

It is a further object of this invention to provide such a buckle assembly that reduces risks associated with the "secondary missile" effect of combat chinstrap buckles.

This invention results from the realization that an extremely easy to engage and disengage chinstrap buckle that inhibits inadvertent disengagement may be accomplished with an engaging member that, when engaged with the mating receiving member, is completely within a recess in the receiving member so that the buckle profile is smooth. Operation of the buckle is then provided for by short, flexible tongues protruding from the buckle members and having enlarged ends that may be grasped by a gloved or mittened hand.

This invention may be accomplished with a quick-release buckle assembly, comprising an engaging member having means for receiving a strap, and a receiving member defining a recess for removably receiving the engaging member in a buckle-engaged position. The engaging member in that position is substantially completely within the peripheral bounds of the recess to prevent inadvertent disengagement of the engaging member from the receiving member. The assembly further includes a flexible tongue protruding from the engaging member to allow the engaging member to be pulled out of the recess to disengage the buckle.

In a preferred embodiment, the flexible tongue includes an enlarged end to ease grasping. This enlarged end may be rigid and formed of plastic material.

Preferably, the buckle includes one or more detents for positioning and holding the engaging member in the recess. This may be accomplished by including protruding shoulders and mating receiving slots in the receiving and engaging members. There may also be included a second set of shoulders and complementary recesses in the engaging and receiving members to help guide the members together during assembly.

Preferably, both the receiving and engaging members are formed of a plastic material such as duPont DELRIN. Grasping of the receiving member may be accomplished with a second flexible tongue attached to the receiving member. The flexible tongue may have a rigid end in the same manner as the engaging member tongue to allow easy operation of the buckle assembly while helping to prevent inadvertent catching of the protruding tongues that could result in inadvertent disassembly of the buckle assembly.

DISCLOSURE OF PREFERRED EMBODIMENT

Other objects, features and advantages will occur to those skilled in the art from the following description of a preferred embodiment and the accompanying drawings, in which.

Figure 1:
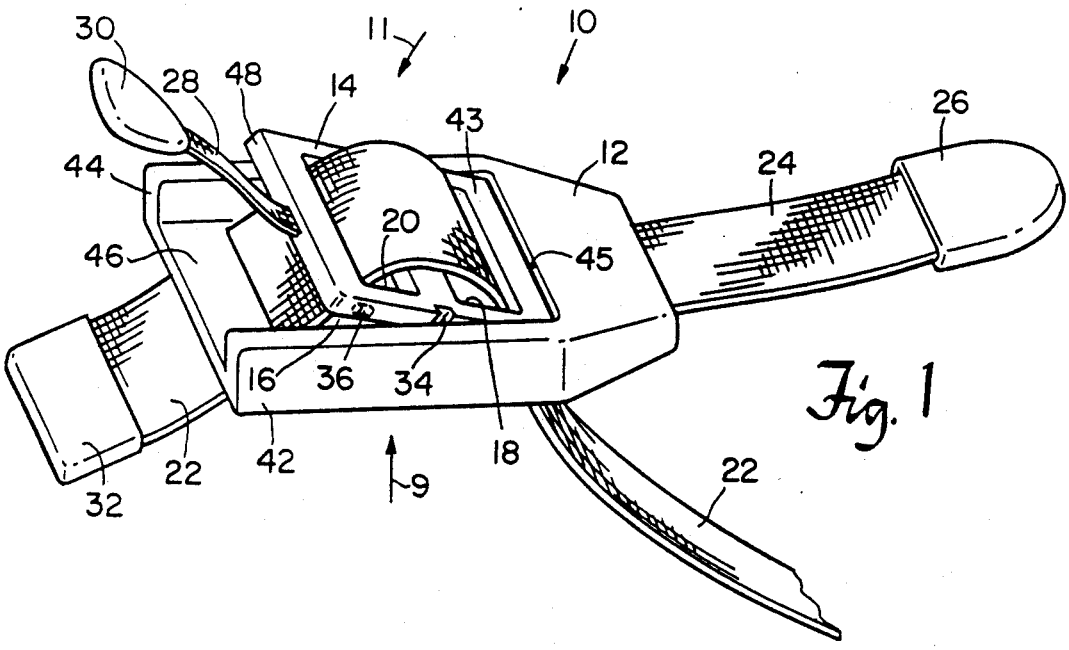
FIG. 1 is an axonometric view of a quick-release buckle assembly according to this invention partially engaged.
Figure 2A:
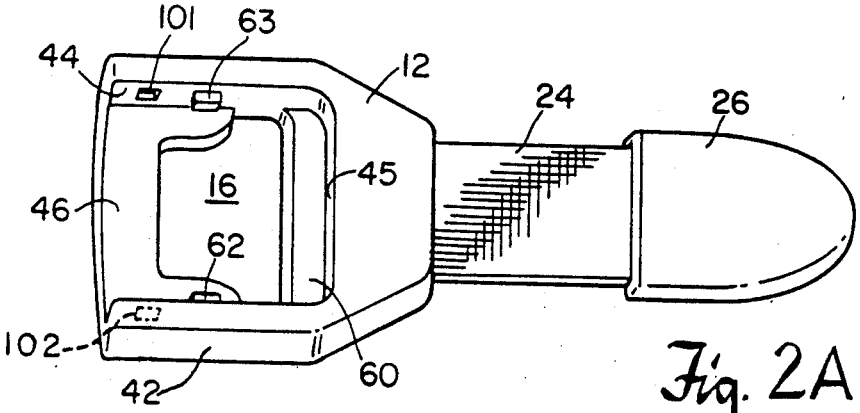
FIGS. 2A and 2B are top plan views of the receiving and engaging members, respectively, of the buckle assembly of FIG. 1.
Figure 2B:
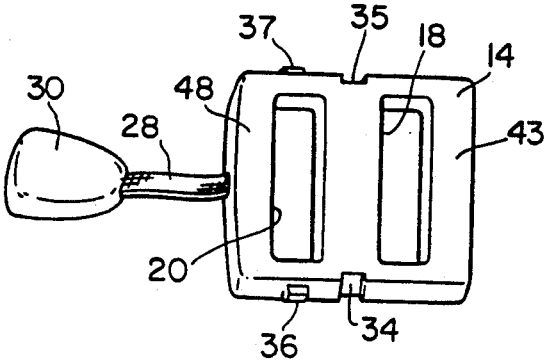

There is shown in FIGS. 1–4 quick release buckle assembly 10 according to this invention. Assembly 10 includes receiving member 12 and engaging member 14 that is adapted to fit within the recess in member 12 formed by sidewalls 42 and 44 and front wall 45 in conjunction with rear depressed platform area 46 and front depressed platform area 60.

As shown in FIG. 1, to assemble buckle assembly 10, engaging member 14 is pushed up through opening 16 in the direction of arrow 9, and front section 43 of engaging member 14 is engaged onto receiving platform 60 and abutting front wall 45. Member 14 is then pushed down in the direction of arrow 11 until rear portion 48 is seated on rear platform 46 of receiving member 12. Slots 34 and 35 in member 14 engage with shoulders 62 and 63, respectively, to guide the members together. Member 14 also includes projecting shoulders 36 and 37 that are adapted to be received within cutouts 102 and 101 in sidewalls 42 and 44, respectively, of member 12. Preferably, members 12 and 14 are made of a plastic material having enough resiliency so that shoulders 36 and 37 can be sized to protrude slightly beyond the diameter of the recess within member 12 to cause shoulders 36 and 37 to be slightly compressed while the buckle is being engaged, and then expand into openings 101 and 102, respectively, to provide a snap fit and also to provide some resistance to disengagement.

Member 12 has protruding from it flexible tongue 24 with rigid end 26 that provides a strap that may be grasped by the user even if the user's hand is gloved or mittened. Similarly, member 14 has thinner flexible strap 28 with enlarged rigid end 30. The straps 24 and 28 allow the user to grasp the members to disengage the buckle. Preferably, both straps 24 and 28 are made of textural textile webbing, type IV, in accordance with MIL-W-43668, and the rigid grasping portions 26 and 30, as well as members 12 and 14, are molded from a plastic material such as DELRIN acetal resin made by EI duPont deNemours and Company. Chinstrap 22 and end 32 may be fabricated in a similar manner.

Figure 3:
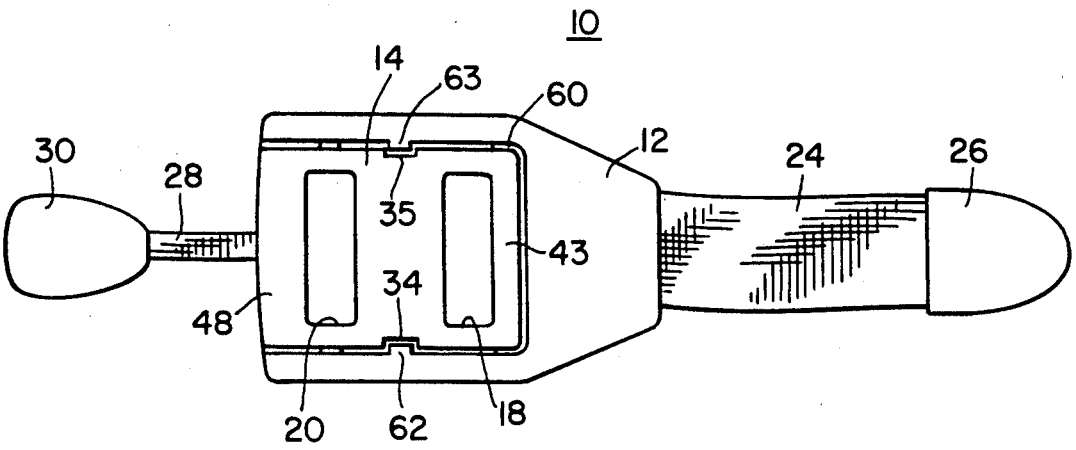
FIG. 3 is a top plan view of the buckle assembly of FIG. 1 in the fully engaged position with the chin strap removed for clarity.
Figure 4:
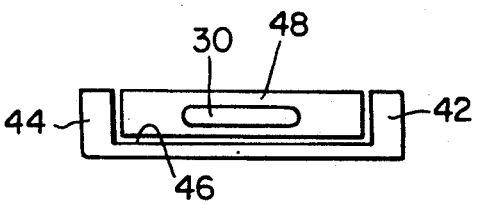
FIG. 4 is an elevational view of the buckle assembly of FIG. 3 showing the sleek profile that inhibits inadvertent buckle disengagement.

As best shown in FIGS. 3 and 4, when buckle assembly 10 is assembled, member 14 is substantially fully within the recess in receiving member 12 formed within sidewalls 42 and 44, wall 45, and bounded on the lower side by receiving platforms 60 and 46, so that no portion of the engaging member protrudes above or beyond the recess. This sleek profile presents no protruding rigid structure that can be inadvertently caught by a hand or article of clothing or equipment, for example, and thereby cause inadvertent release of the buckle assembly. Operation of the buckle is accomplished instead with the flexible tongues protruding from the members having the relatively large ends which can be easily grasped by the user and yet have enough flexibility or give to successfully inhibit their being caught inadvertently.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A quick-release buckle assembly, comprising:

an engaging member having a pair of slots through which a strap is threaded and retained;

a receiving member defining a recess for removably receiving said engaging member in a buckle-engaged position;

said engaging member in the buckle-engaged position being disposed substantially completely within the peripheral bounds of said recess to prevent inadvertent disengagement of said engaging member from said receiving member;

said engaging member in the buckle-disengaged position being detached from said receiving member; and a flexible tongue protruding from said engaging member to allow said engaging member to be pulled out of said recess to disengage the buckle.

2. The quick-release buckle of claim 1 in which said tongue includes an enlarged end to ease grasping.

3. The quick-release buckle of claim 2 in which said enlarged end is rigid.

4. The quick-release buckle of claim 3 in which said enlarged end is made of a plastic material.

5. The quick-release buckle of claim 1 further including detent means for positioning and holding said engaging section in said recess.

6. The quick-release buckle of claim 5 in which said recess has two side walls.

7. The quick-release buckle of claim 6 in which said detent means are partially in said side walls.

8. The quick-release buckle of claim 7 in which said detent means includes protruding shoulders projecting from said engaging member.

9. The quick-release buckle of claim 8 further including shoulder-receiving recesses in said receiving member side walls for engaging said protruding shoulders in the buckle-engaged position.

10. The quick-release buckle of claim 1 in which said receiving and engaging members are made of a plastic material.

11. The quick-release buckle of claim 1 further including means for allowing grasping of said receiving member.

12. The quick-release buckle of claim 11 in which said means for allowing grasping includes a flexible tongue protruding from said receiving member.

13. The quick-release buckle of claim 12 in which said tongue includes a rigid end.

14. The quick-release buckle of claim 12 in which said tongue is a fabric member with a formed plastic rigid end.

15. A quick-release buckle assembly, comprising:

a plastic engaging member having a pair of slots through which a strap is threaded and retained;

a plastic receiving member defining a recess for removably receiving said engaging member in a buckle-engaged position;

said engaging member in the buckle-engaged position being disposed substantially completely within the peripheral bounds of said recess to prevent inadvertent disengagement of said engaging member from said receiving member;

said engaging member in the buckle-disengaged position being detached from said receiving member; and a first flexible tongue having an enlarged plastic end and protruding from said engaging member to allow said engaging member to be pulled out of said recess to disengage the buckle; and a second flexible tongue having a plastic end and protruding from said receiving member to allow said receiving member to be grasped during buckle operation.

* * * * *